US007944457B2

(12) United States Patent
Lin et al.

(10) Patent No.: US 7,944,457 B2
(45) Date of Patent: May 17, 2011

(54) IMAGE DISPLAY METHOD

(75) Inventors: Tzung-I Lin, Miao-Li County (TW); Yi-Chun Lu, Miao-Li County (TW); Chia-Yin Lu, Miao-Li County (TW)

(73) Assignee: Coretronic Corporation, Hsinchu (TW)

( * ) Notice: Subject to any disclaimer, the term of this patent is extended or adjusted under 35 U.S.C. 154(b) by 1370 days.

(21) Appl. No.: 11/436,227

(22) Filed: May 17, 2006

(65) Prior Publication Data

US 2006/0268021 A1 Nov. 30, 2006

(30) Foreign Application Priority Data

May 26, 2005 (TW) ..... 94117193 A

(51) Int. Cl.
*G09G 5/10* (2006.01)

(52) U.S. Cl. ..... 345/690; 345/74.1; 345/102; 345/75.2; 345/60

(58) Field of Classification Search ..... None
See application file for complete search history.

(56) References Cited

U.S. PATENT DOCUMENTS 6,873,308 B2 * 3/2005 Sagano et al. ..... 345/75.2
2004/0066356 A1 * 4/2004 Yun et al. ..... 345/60

FOREIGN PATENT DOCUMENTS

JP 06-259034 9/1994
JP 2005-070690 3/2005
TW 1230551 4/2005

* cited by examiner

*Primary Examiner* — Bipin Shalwala
*Assistant Examiner* — Kelly Hegarty
(74) *Attorney, Agent, or Firm* — J.C. Patents

(57) ABSTRACT

An image display method adapted for a digital display apparatus is provided. The image display method includes the steps of: first, detecting a maximum average picture level of each picture displayed by the digital display apparatus; judging whether the maximum average picture level is larger than a reference value; determining a displaying mode of each picture according to the judgment. The image display method is adapted for improving the displaying quality of a digital display apparatus.

4 Claims, 4 Drawing Sheets

IMAGE DISPLAY METHOD

CROSS-REFERENCE TO RELATED APPLICATION

This application claims the priority benefit of Taiwan application serial no. 94117193, filed on May 26, 2005. All disclosure of the Taiwan application is incorporated herein by reference.

BACKGROUND OF THE INVENTION

1. Field of the Invention

The present invention relates to an image display method, and particularly to an image display method being adapted for a digital display apparatus.

2. Description of Related Art

Nowadays, although the displaying quality of digital display apparatuses has been remarkably improved, there still is room for further improvement. For instance, a conventional digital display apparatus usually provides a high-brightness mode and a high-contrast mode for users to select. According to such a conventional digital display apparatus, selecting the high-brightness mode makes the bright images look more vivid and the dim images having poor contrast in which those parts originally should be displayed as black look grayish; contrarily, selecting the high-contrast mode makes the dim images have better contrast and the bright images look darkish. Therefore, a conventional digital display apparatus can not simultaneously obtain good performance of contrast of the dim images and brightness of the bright images.

Texas Instruments Incorporated (TI) provides a digital projection apparatus having a changeable lens aperture in which the lens aperture enlarges to improve the image brightness when displaying bright images and shrinks to improve the image contrast ratio when displaying dim images.

Unfortunately, the lens aperture of such usually can not respond immediately and the switching between the bright images and the dim images that is too distinct and uncomfortable for viewers. Furthermore, doing so needs an extra mechanic component installed into the lens, by which not only the production cost will be increased which makes the product uncompetitive, but also the product malfunction will likely be occurred accordingly. Moreover, the foregoing modification can be applied to digital projection apparatuses only, not to other digital display apparatuses.

SUMMARY OF THE INVENTION

In view of the above, an object of the present invention is to provide an image display method for improving a displaying quality of a digital image display apparatus.

Another object of the present invention is to provide an image display method for making switching displaying modes unobvious to viewers.

According to the above and other objects, the present invention provides an image display method adapted for a digital display apparatus. The image display method includes the steps of: first, detecting a maximum average picture level $M_n$ of each picture displayed by the digital display apparatus, wherein n is a positive integer; judging whether the maximum average picture level $M_n$ of each picture is larger than a reference value $M_r$; determining the displaying mode of each picture according to the judgment.

The present invention provides another image display method adapted for a digital display apparatus. The image display method includes the steps of: first, detecting a maximum average picture level $M_n$ of each picture displayed by the digital display apparatus, wherein n is a positive integer; calculating the difference $D_n$ between the maximum average picture level of each picture $M_n$ and the maximum average picture level of the previous picture $M_{n-1}$; judging whether the difference $D_n$ is larger than a reference value $D_r$, when $D_n<D_r$, then the displaying mode no need to be switched; and when $D_n>D_r$, then judging whether the maximum average picture level $M_n$ is larger than a reference value $M_r$ for determining the displaying mode of each picture.

According to the two above-mentioned image display methods, the method for detecting the maximum average picture level $M_n$ of each picture for example can include the steps of: first, detecting respectively the red average picture level, green average picture level and blue average picture level of each picture; finding the maximum value among the red, green and blue average picture levels of each picture as the maximum average picture level $M_n$ of each picture.

According to the two above-described image display methods, the method for determining the displaying mode for each picture, for example, can be: using the first displaying mode when $M_n>M_r$ and using the second displaying mode when $M_n<M_r$.

The above-described image display methods for example further includes employing an image micro-adjusting mechanism, wherein the image micro-adjusting mechanism for example includes adjusting a Gamma value, brightness or contrast of each picture, or a combination of the described.

The present invention provides a method for switching displaying modes according to the maximum average picture level of each picture. The method being adapted for a digital display apparatus can respectively switch different displaying modes for the displayed bright images and dim images so that the bright images look more vivid and the contrast of the dim images are improved. In summary, the image display method according to the present invention is adapted for improving the displaying quality of a digital display apparatus.

Furthermore, according to another image display method provided by the present invention, switching the displaying mode or not is determined according to the difference between the maximum average picture level of each picture and the maximum average picture level of a previous picture. As a result, a viewer is not sensitive toward the switching between the displaying modes; hence, the viewer does not feel uncomfortable.

DESCRIPTION OF THE EMBODIMENTS

The First Embodiment

Figure 1:
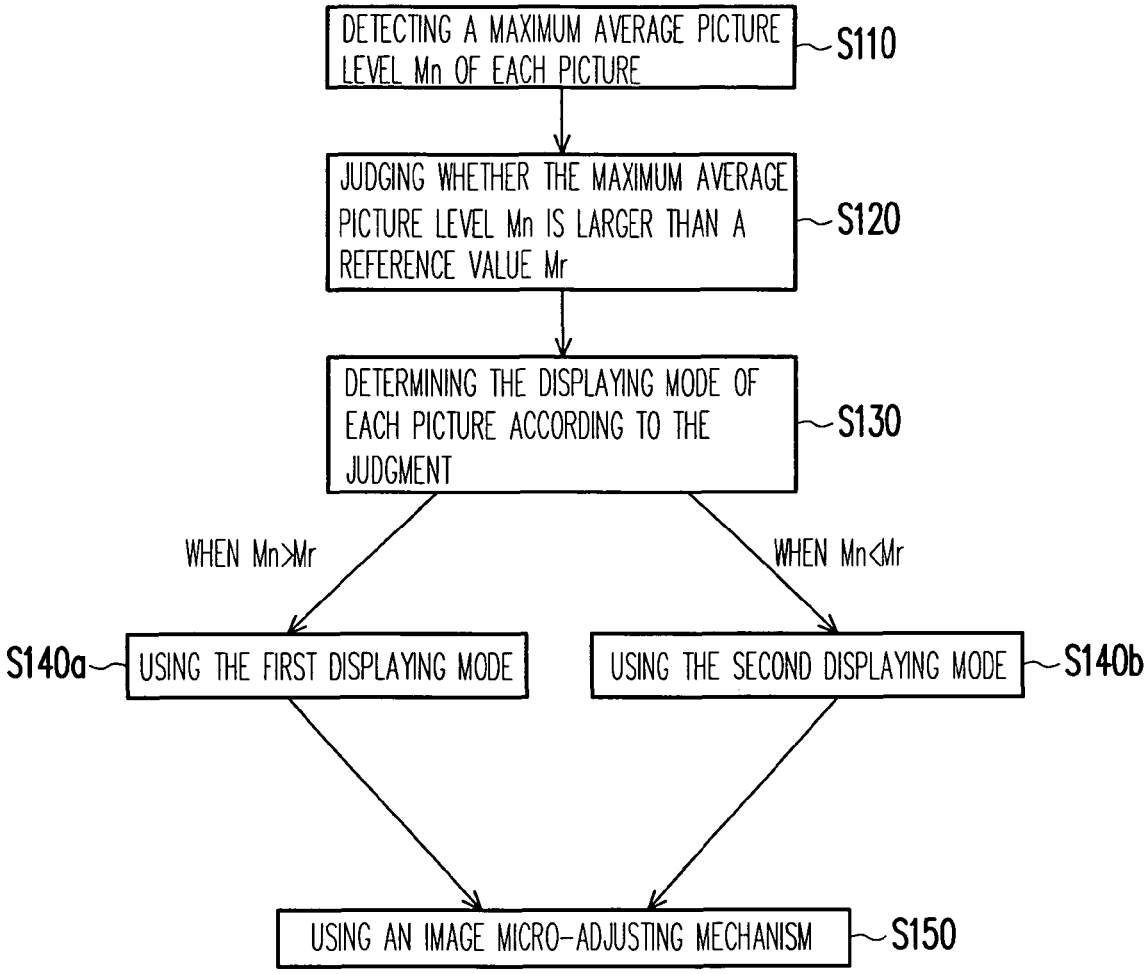
FIG. 1 is a flowchart illustrating an image display method according to the first embodiment of the present invention.

FIG. 1 is a flowchart illustrating an image display method according to the first embodiment of the present invention.

Referring to FIG. 1, an image display method according to the embodiment is adapted for a digital display apparatus, the image display method including the steps as below:

First, as shown in step S110, a maximum average picture level $M_n$ of each picture displayed by the digital display apparatus is detected, wherein n is a positive integer and $M_n$ represents the maximum average picture level of the picture No. n. According to the embodiment, the method for detecting the maximum average picture level $M_n$ of each picture for example includes the steps of: first, detecting respectively the red average picture level, green average picture level and blue average picture level of each picture; finding the maximum value among the red, green and blue average picture levels of each picture as the maximum average picture level $M_n$ of each picture.

Then, in step S120, whether the maximum average picture level $M_n$ is larger than a reference value $M_r$ is judged, wherein the reference value $M_r$ for example is adapted for judging whether the picture is a bright image or a dim image. When $M_n>M_r$, the picture No. n is classified as the bright image, and when $M_n<M_r$, the picture No. n is classified as the dim image.

Then, as shown in step S130, displaying modes of each picture according to the judgment obtained from step S120 are determined. The displaying modes include a first and second displaying mode. Wherein, the first displaying mode is to be used when $M_n>M_r$ and the second displaying mode is to be used when $M_n<M_r$. In other words, suppose the displaying mode of the picture No. n−1 is classified as the first displaying mode, when $M_n>M_r$, the displaying mode of the picture No. n is sustained as the first displaying mode; otherwise, when $M_n<M_r$. the displaying mode of the picture No. n is switched to the second displaying mode. Similarly, suppose the displaying mode of the picture No. n−1 is classified as the second displaying mode, when $M_n>M_r$, the displaying mode of the picture No. n is switched to the first displaying mode; otherwise, when $M_n<M_r$, the displaying mode of the picture No. n is sustained as the second displaying mode. Moreover, when $M_n=M_r$, the first displaying mode or the second displaying mode can be selected, depending on users.

According to an aspect of the embodiment, the first displaying mode for example is a high-brightness mode, and the second displaying mode for example is a high-contrast mode. In other words, the high-brightness mode is used for obtaining a comparatively vivid image when displaying a bright image, and the high-contrast mode is used for displaying comparatively pure blackness of an image and further improve the general contrast of the image when displaying a dim image. As a result, a digital display apparatus employing the present invented image display method can simultaneously obtain better performances of contrast of the dim images and brightness of the bright images.

According to the first embodiment of the present invention, the method for switching the displaying mode for example is to adjust the brightness of the light source of the digital display apparatus, and the brightness of the light source for example is adaptively adjusted according to the maximum average picture level $M_n$ of each picture. For example, in a digital projection apparatus, to switch from a high-brightness mode to a high-contrast mode, the light power is reduced for decreasing the brightness of the light source; otherwise, to switch from a high-contrast mode to a high-brightness mode, the light power is increased for increasing the brightness of the light source. Further, an optical attenuator can be added for adjusting the light source brightness. The optical attenuator can be cut into the light transmitting path when requiring a lower brightness light source to reduce the brightness of the light source.

The image display method according to the embodiment for example further includes an image micro-adjusting mechanism. The image micro-adjusting mechanism for example includes adjusting the Gamma value, the brightness or the contrast of each picture, or the combination of the described.

Figure 2A:
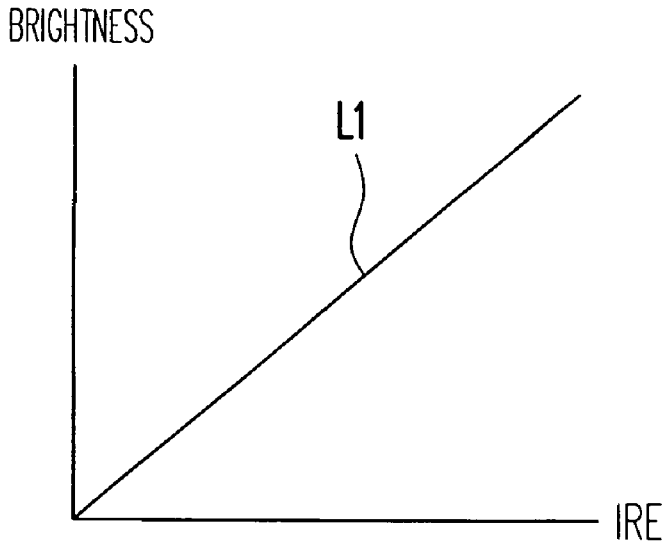
FIGS. 2A and 2B are schematic diagrams illustrating a Gamma curve relationship of proceeding an image micro-adjusting mechanism according to the first embodiment of the present invention.
Figure 2B:
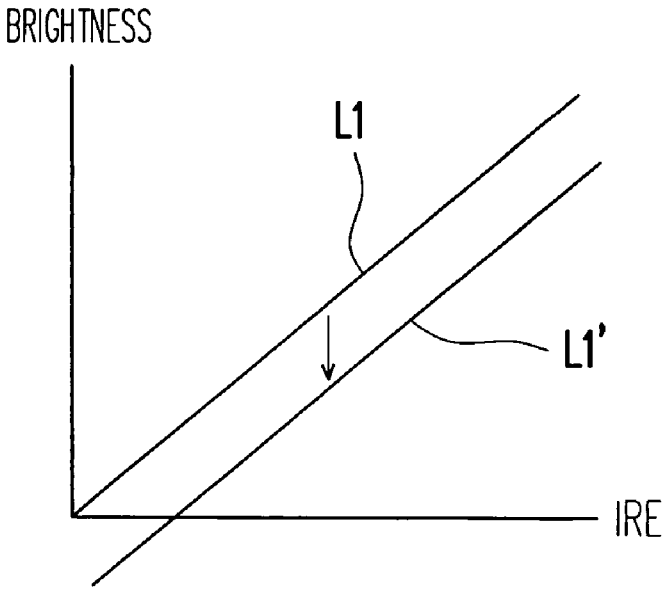

FIGS. 2A and 2B are schematic diagrams illustrating a Gamma curve relationship of proceeding an image micro-adjusting mechanism according to the first embodiment of the present invention. Referring to FIGS. 2A and 2B, if the displaying mode of the picture No. n is a high-brightness mode, the foregoing image micro-adjusting mechanism, for example, is first setting the Gamma curve of the picture No. n as a Gamma curve L1 (as shown in FIG. 2A), then reducing the brightness of the picture No. n to change the Gamma curve L1 to Gamma curve L1' (as shown in FIG. 2B). Thus, the obtained picture No. n can be displayed with more saturate color performance and higher contrast ratio.

Figure 3A:
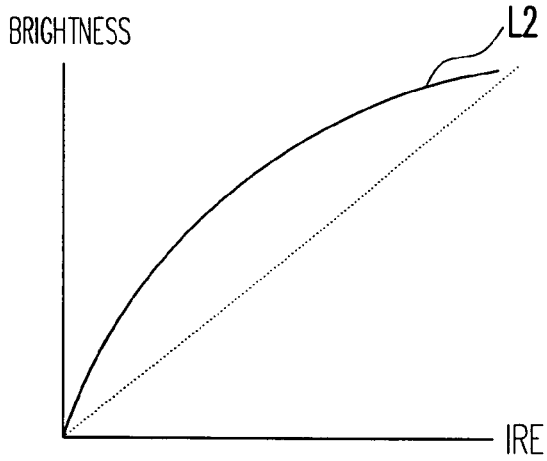
FIGS. 3A to 3C are schematic diagrams illustrating a Gamma curve relationship of proceeding another image micro-adjusting mechanism according to the first embodiment of the present invention.
Figure 3B:
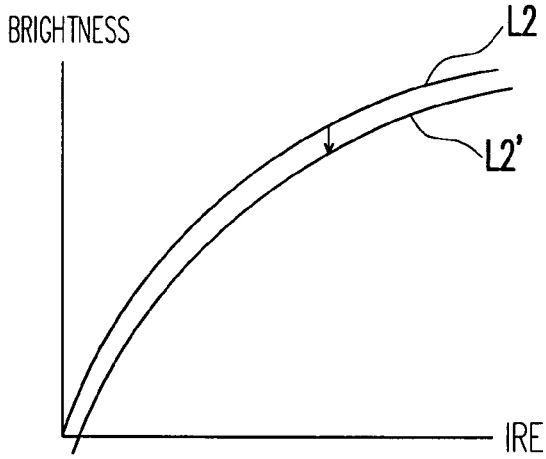
Figure 3C:
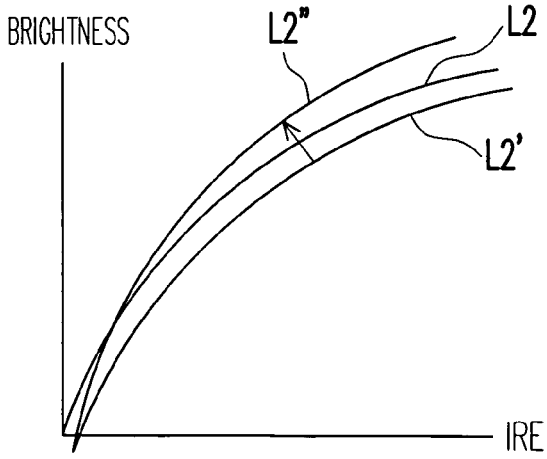

FIGS. 3A to 3C are schematic diagrams illustrating a Gamma curve relationship of proceeding another image micro-adjusting mechanism according to the first embodiment of the present invention. Referring to FIGS. 3A to 3B, if the displaying mode of the picture No. n is a high-contrast mode, the foregoing image micro-adjusting mechanism for example is first setting the Gamma curve of the picture No. n as a Gamma curve L2 (shown as FIG. 3A), then reducing the brightness of the picture No. n for changing the Gamma curve L2 to a Gamma curve L2' (as shown in FIG. 3B) and further increasing the contrast ratio of the picture No. n for changing the Gamma curve L2' to a Gamma curve L2" (as shown in FIG. 3B). Furthermore, the obtained picture No. n can be displayed with purer black color and the overall picture is more stereoscopic.

Without adding any other component, the image display method according to the present invention can improve the image displaying quality of a digital display apparatus and thus the production cost for a digital display apparatus is saved. Moreover, the image display method can be used not only in a digital projection apparatus, but also a plasma display apparatus, an LCD apparatus or other various digital display apparatuses.

The Second Embodiment

Figure 4:
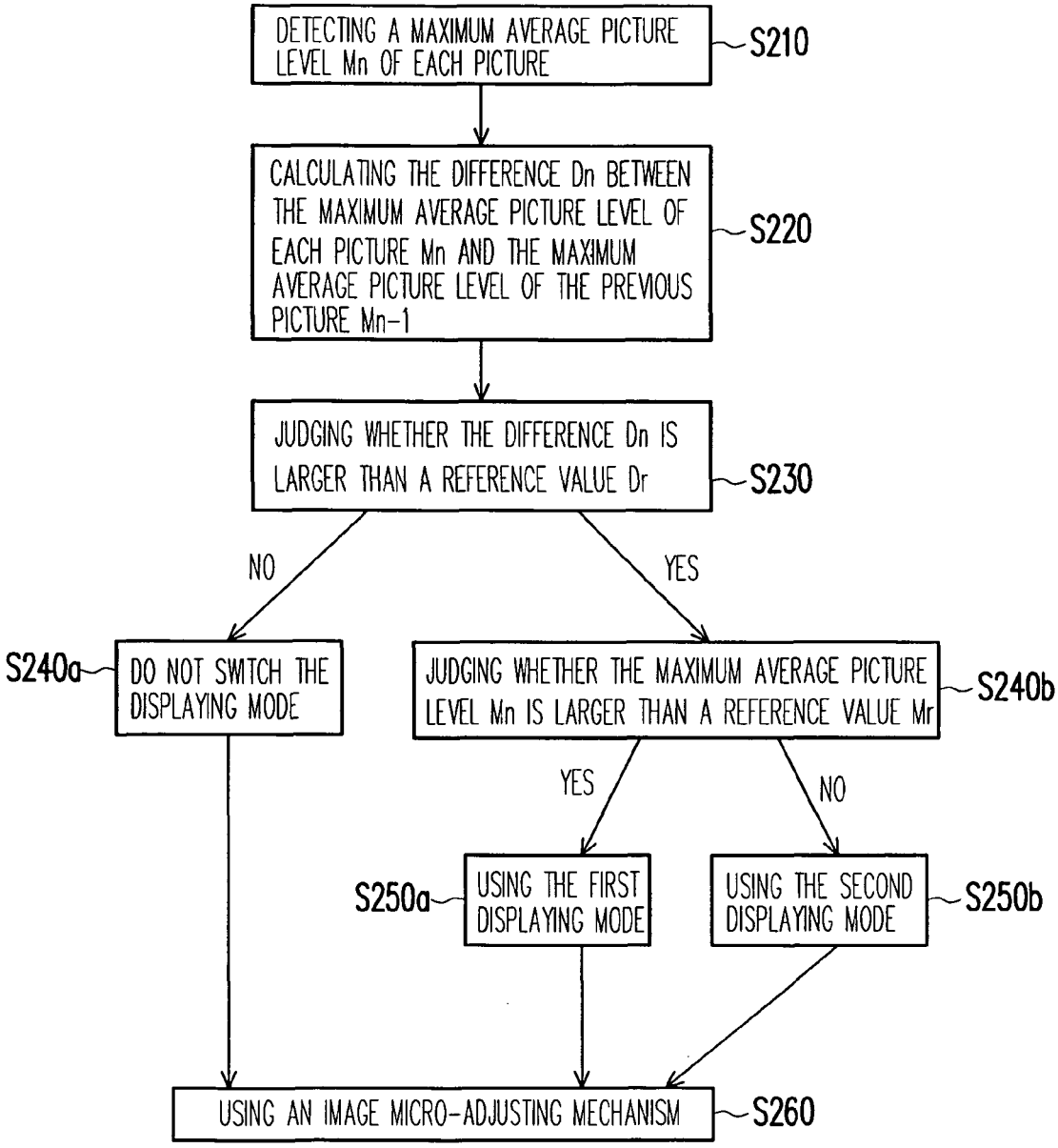
FIG. 4 is a flowchart illustrating an image display method according to the second embodiment of the present invention.

Referring to FIG. 4, an image display method according to the embodiment is adapted for a digital display apparatus. The image display method includes the steps as below:

First, as shown in step S210, a maximum average picture level $M_n$ of each picture displayed by the digital display apparatus is detected, wherein n is a positive integer and $M_n$ represents the maximum average picture level of the picture No. n. According to the embodiment, the method for detecting the maximum average picture level $M_n$ of each picture is similar with that of the first embodiment and is not to be repeated herein;

Then, in step S220, the difference $D_n$ between the maximum average picture level of each picture $M_n$ and the maximum average picture level of the previous picture $M_{n-1}$ is calculated.

Then, as shown in step S230, whether the difference $D_n$ is larger than a reference value $D_r$ is judged; when $D_n<D_r$, then the displaying mode no need to be switched; and when $D_n>D_r$, then performing step S240*b* to judge whether the maximum average picture level is larger than a reference value $M_r$ for determining the displaying mode of each picture according to the obtained results. Step S240*b* is similar with steps S120 and S130, the detailed description can be referred to the description of steps S120 and S130 of the first embodiment. Furthermore, the difference reference value $D_r$ is the least difference not being recognized by human eyes when the maximum average picture levels are changed between two images.

Further, switching displaying mode under the condition of $D_n<D_r$ is comparatively distinct to viewers, the image display method according to the embodiment judges whether $D_n>D_r$ before determining switching displaying mode or not, therefore, the viewer can be avoided from feeling uncomfortable due to the sensible switching between display modes. In other words, under the condition of $D_n>D_r$, suppose the displaying mode of the picture No. n−1 is classified as a first displaying mode and the maximum average picture level of picture No. n $M_n$ is smaller than a reference value $M_r$, the displaying mode of the picture No. n is sustained as a first displaying mode; similarly, under the condition of $D_n<D_r$, suppose the displaying mode of the picture No. n−1 is classified as a second displaying mode and the maximum average picture level of picture No. n $M_n$ is larger than a reference value $M_r$, the displaying mode of the picture No. n is sustained as a second displaying mode. Moreover, when $D_n=D_r$, the displaying mode is not switched or perform step S240*b* for determining the displaying mode for the picture No. n.

The image display method according to the embodiment for example further includes an image micro-adjusting mechanism after steps S240*a*, S250*a* and S250*b* for improving the image quality. Since the image micro-adjusting mechanism of the embodiment is similar to that of the first embodiment, details of the image micro-adjusting mechanism of the embodiment can be referred to the first embodiment and is not repeated herein.

In view of the above, the image display method according to the present invention has at least the following advantages:

1. Since the present invention provides a method for switching different displaying modes according to the contents of the images, the bright images can be displayed vividly and the contrast of the dim images can be improved. In summary, the image display method according to the present invention is adapted for improving the displaying quality of a digital display apparatus.
2. In the second embodiment, whether to switch displaying mode is determined by the difference between the maximum average picture levels of each picture and of its previous picture. Therefore, the viewer can be avoided from feeling uncomfortable due to the sensible switching between display modes.
3. Without adding any other component, the image display method according to the present invention can improve the image displaying quality of a digital display apparatus and the production cost is saved.
4. The image display method according to the present invention can be used in various digital display apparatuses.

It should be noted that specific embodiments of, and examples for, the invention are described herein for illustrative purposes, various equivalent modifications are possible within the scope of the invention, as those skilled in the relevant art will recognize that modifications and adaptations of the above-described preferred embodiments of the present invention may be made to meet particular requirements. This disclosure is intended to exemplify the invention without limiting its scope. All modifications that incorporate the invention disclosed in the preferred embodiment are to be construed as coming within the scope of the appended claims or the range of equivalents to which the claims are entitled.

What is claimed is:

1. An image display method, being adapted for a digital display apparatus, comprising:

detecting a maximum average picture level $M_n$ of each picture displayed by the digital display apparatus, wherein n is a positive integer;

calculating a difference $D_n$ between the maximum average picture level $M_n$ of each picture and a maximum average picture level $M_{n-1}$ of the previous picture;

judging whether the difference $D_n$ is larger than a reference value $D_r$; and when $D_n<D_r$, no need to switch a displaying mode; and when $D_n>D_r$, then judging whether the maximum average picture level $M_n$ is larger than a reference value $M_r$ for determining the displaying mode of each picture, and wherein the method for detecting the maximum average picture level $M_n$ each picture comprises steps of:

detecting respectively a red average picture level, a green average picture level and a blue average picture level of each picture; and finding the maximum value among the red, green and blue average picture levels of each picture as the maximum average picture level $M_n$ of each picture.

2. The image display method according to claim 1, wherein the method for determining the displaying mode for each picture comprises:

using a first displaying mode when $M_n>M_r$; and using a second displaying mode when $M_n<M_r$.

3. The image display method according to claim 1 further comprising an image micro-adjusting mechanism.

4. The image display method according to claim 3, wherein the image micro-adjusting mechanism comprises adjusting a Gamma value, a brightness or a contrast of each picture, or a combination of the above described.

* * * * *